United States Patent [19]

Karg et al.

[11] Patent Number: 4,797,059

[45] Date of Patent: Jan. 10, 1989

[54] SEAT HANDLING FIXTURE

[75] Inventors: Rodrick D. Karg, Oxford; Thomas N. Whetstone, Clarkston, both of Mich.

[73] Assignee: General Motors Corporation, Detroit, Mich.

[21] Appl. No.: 193,157

[22] Filed: May 6, 1988

Related U.S. Application Data

[63] Continuation of Ser. No. 928,812, Nov. 7, 1986, abandoned.

[51] Int. Cl.[4] ..... B66F 9/00

[52] U.S. Cl. ..... 414/590; 29/429; 29/701; 294/67.22; 414/399; 414/591; 414/626; 414/739

[58] Field of Search ..... 414/626, 591, 399, 684, 414/684.3, 739, 921, 589, 590; 901/7, 37, 39; 212/166, 196, 242; 294/67.2, 67.21, 67.22; 29/429, 701

[56] References Cited

U.S. PATENT DOCUMENTS

| | | | |
|---|---|---|---|
| 3,185,511 | 5/1965 | Wochner et al. | 403/377 |
| 3,709,547 | 1/1973 | Nutter | 294/67.21 |
| 3,727,968 | 4/1973 | Tsuchihashi et al. | 414/626 X |
| 4,167,979 | 9/1979 | Freese et al. | 172/818 |
| 4,519,644 | 5/1985 | Song | 296/136 |

FOREIGN PATENT DOCUMENTS

| | | | |
|---|---|---|---|
| 1816652 | 6/1979 | Fed. Rep. of Germany | 294/67.21 |
| 647227 | 2/1979 | U.S.S.R. | 294/67.22 |
| 850007 | 9/1960 | United Kingdom | 414/626 |

*Primary Examiner*—Robert J. Spar
*Assistant Examiner*—David A. Bucci
*Attorney, Agent, or Firm*—Ernest E. Helms

[57] ABSTRACT

The present invention provides an apparatus and method of utilization of the same of a fixture used for the placement of seats in a vehicle body or cab structure. The present invention provides a "C" frame which may be attached to an overhead lifting device, a first link pivotally connected to the "C" frame, and a second link angularly and pivotally connected to the first link for penetrating between the seat back and seat cushion. A lifting mechanism is provided for raising the second link thereby causing the seat to be captured by the fixture so that the seat can be transported by the lifting device.

8 Claims, 2 Drawing Sheets

SEAT HANDLING FIXTURE

This is a continuation of application Ser. No. 928,812 filed on Nov. 7, 1986, now abandoned The field of the present invention is that of fixtures for the assembly of motor vehicles. More particularly the field of the present invention is that of fixtures for the assembly of seats into the body or cab structure of a motor vehicle and methods of utilization of the same.

DISCLOSURE STATEMENT

Typically the seat is one of the last articles to be mounted within a vehicle. One of the problems of placing the seat within the vehicle body is the tight clearances involved caused by the prior installation of the steering column and wheel. The above noted problem can be particularly acute in the assembly of truck cab bodies. In most trucks there is no provision for space to accommodate a rear seat, therefore rearward clearance is extremely limited.

Prior to the present invention two methods have been utilized to place the seat within the vehicle. The first method is to manually place the seat within the vehicle. This method can often be strenuous on an assembler since the bench seats of many vehicles weigh approximately 100 pounds. Assuming an eight-hour shift with a vehicle production rate of 60 vehicles per hour, the assembler can be required to lift 48,000 pounds in a single day. The above effort can sometimes be fatiguing. The second method of placing the seat within the vehicle is an automated fixture which crosses over the top of the seat and grabs the bench seat by both sides. The fixture then moves in a direction transverse to the directional axis of the vehicle to place the seat within the vehicle. A major problem with the above described device is that it is often hard to operate. Also the prior fixtures are very difficult to operate within the tight clearances imposed by the steering column and wheel. Still another problem with the prior automated fixtures is that they are mainly suitable for the installation of bench type seats and are not be easily modified for the installation of bucket seats into the vehicle.

SUMMARY OF THE INVENTION

To overcome the above noted and other problems the present invention is brought forth. The present invention provides a seat installation fixture which allows the seat to be picked up outside of the vehicle and then be placed within the vehicle without grabbing both sides of the vehicle seat. The present invention also provides a fixture taking up less space within the vehicle. A preferred embodiment of the present invention, to be described later, is also advantageous in that it may be utilized on both conventional bench seating, sixty-forty split type bench seating, or bucket seating.

The present inventive fixture includes a "C" frame with a pivotally connected first link projecting downward therefrom. The first link has projecting therefrom at an angle a pivotally connected second link. The fixture is positioned by the operator to an area adjacent to the seat. The operator swings the first link to allow the second link to penetrate between the seat back and the seat cushion. A lifting means, commonly referred to as an actuator, is activated to angularly raise the second link, therefore causing the seat to be captured to the fixture. The fixture is then positioned by the lifting device to place the seat within the vehicle body. No portion of the fixture at any time makes contact with any portions of the vehicle body when installing the seat.

It is an object of the present invention to provide a fixture and method of utilization of the same for the installation of seating into motor vehicles.

It is also an object of the present invention to provide a fixture for use with an overhead lifting device for transporting a seat having a seat back and a seat cushion into a vehicle including a "C" frame with upper and lower legs, the upper leg providing means of connection with the lifting device, left and right first links pivotally connected at one end with the lower leg of the "C" frame and projecting in a generally downward direction, a contact pad coated with a frictional engaging elastomeric material adjacent to each of the first links for engaging with the seat back, left and right stainless steel second links pivotally connected to the other end of the respective first links remote from the "C" frame at an angle with the first links for penetrating between the seat back and the seat cushion, and a piston actuator pivotally joined with each of the respective first and second links to angularly raise the second links whereby the seat is captured with the fixture so that the seat can be transported by the lifting device.

It is also an object of the present invention to provide a method of transporting a seat with a seat back and a seat cushion into a vehicle, including connecting to the lifting device an upper leg of a "C" frame having upper and lower legs, pivotally connecting with the lower leg of the "C" frame a first link projecting in a generally downward direction, pivotally connecting to the first link a second link at an end of the first link remote from the "C" frame and at an angle with the first link, penetrating between the seat back and the seat cushion the second link, and angularly lifting the second link whereby the seat is captured with the fixture, and transporting the seat with the lifting device whereby the seat is placed into the vehicle.

Other objects, desires and advantages of the present invention will become more apparent to those skilled in the art as the nature of the invention is better understood from the accompanying drawings and a detailed description.

DETAILED DESCRIPTION OF THE DRAWINGS

Figure 1:
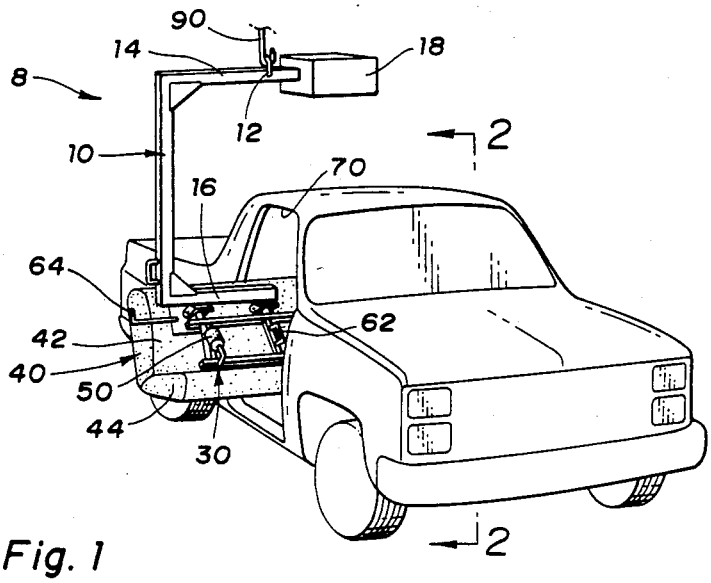
FIG. 1 is a perspective view illustrating the installation of a seat into a motor vehicle.
Figure 2:
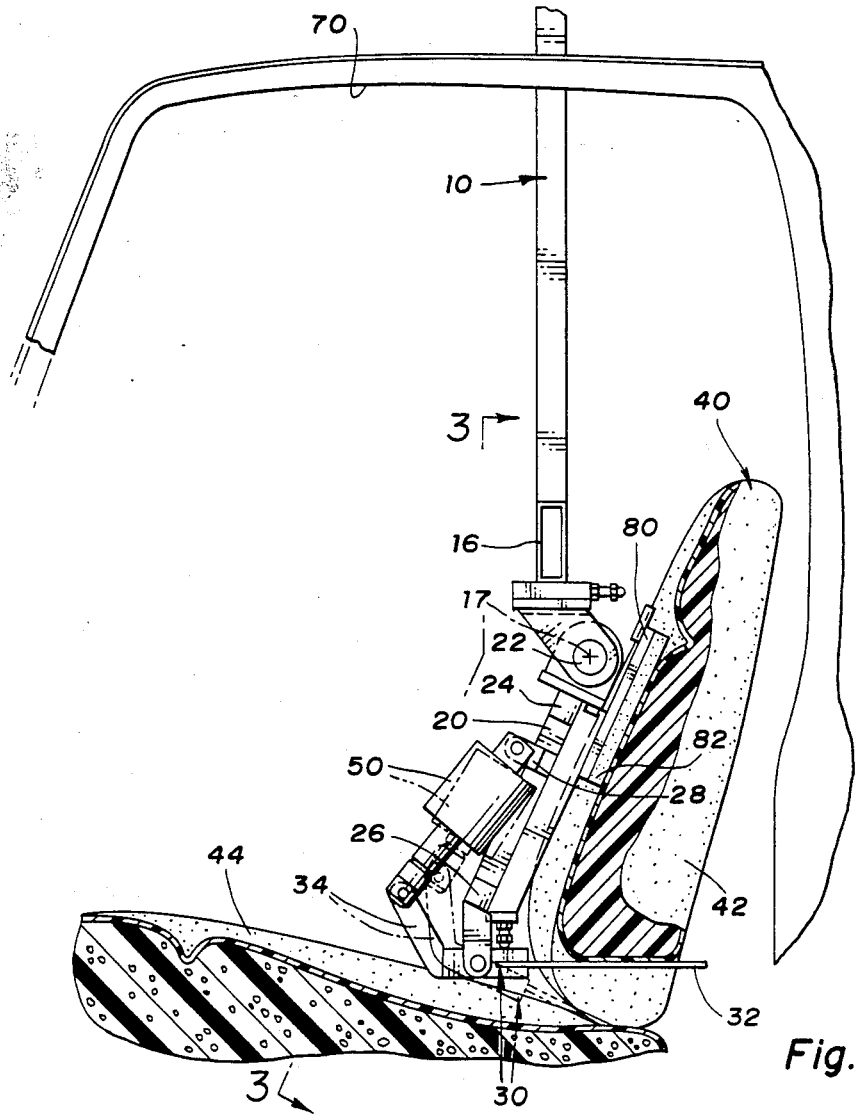
FIG. 2 is a view taken along line 2—2 of FIG. 1.
Figure 3:
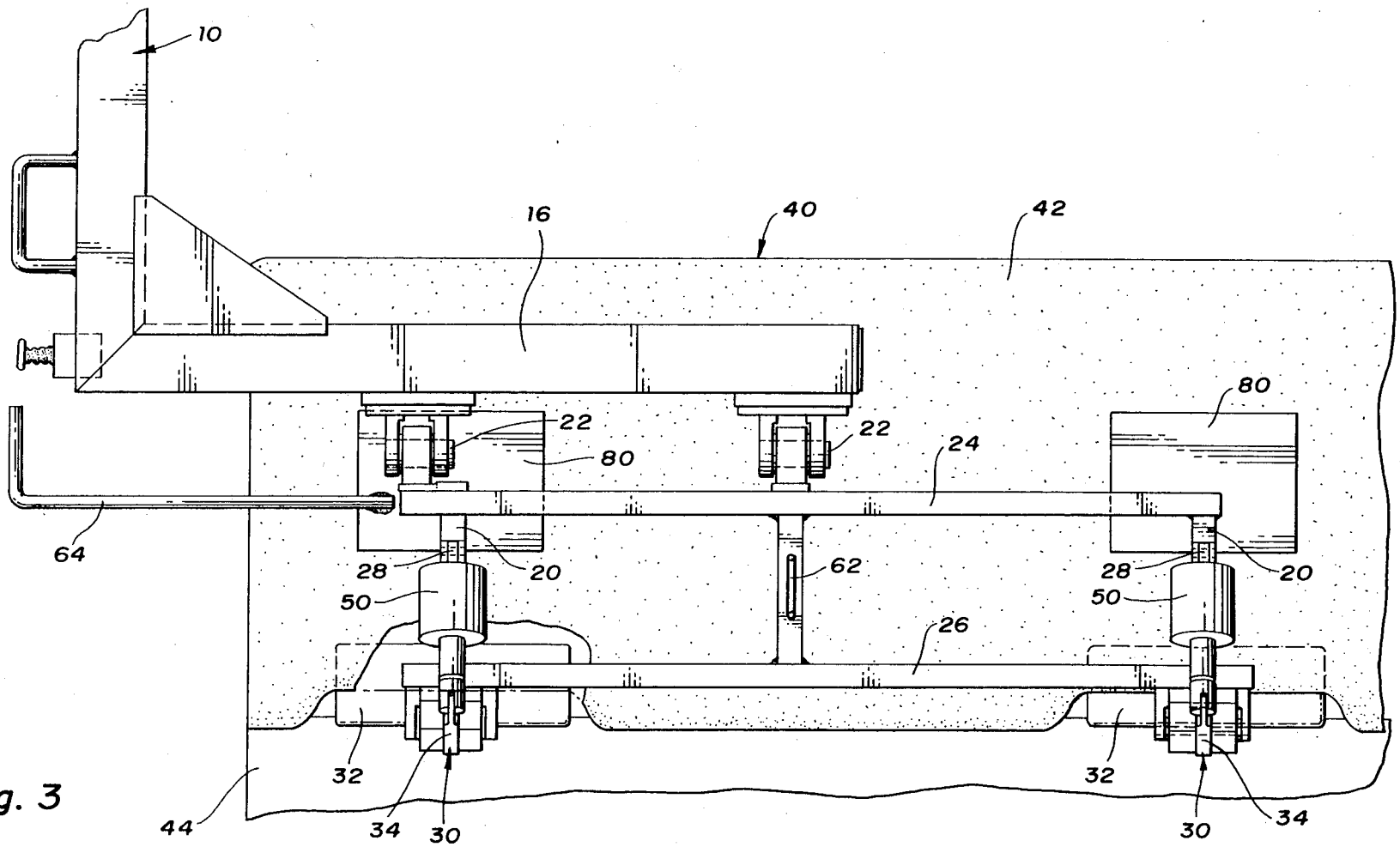
FIG. 3 is a view taken along line 3—3 of FIG. 2.

Referring to FIGS. 1, 2 and 3 the fixture 8 of the present invention has a "C" frame 10. The "C" frame 10 has an upper leg 14 and a lower leg 16 spaced from one another and separated by a horizontal portion. The upper leg 14 via an eyelet 12 provides the means of connection of the fixture with a lifting device such as an overhead cranehook 90. Also at the end of the upper leg 14 is a counterbalance weight 18 which may be fixably or removably connected with the "C" frame 10 depending upon the application in which the fixture utilized.

Pivotally connected at one end with the lower leg 16 along an axis generally parallel with the lower leg 16 with a bearing type connection 22 and projecting generally downwardly therefrom is a first link 20. The first link can be directly pivotally connected with the lower leg 16 of the "C" frame 10 or may be indirectly pivotally connected with the "C" frame via a top crossbar 24. In the embodiment illustrated there are left and right first links 20 allowing the fixture 10 to be utilized for installing conventional bench seating, sixty-forty split bench seating and/or two bucket seats. It is usually preferable to have the first links 20 joined at their bottom by a crossbar 26 in order to provide rigidity to the fixture 8. Also crossbar 26 allows the first links 20 to pivot in unison with respect to the lower leg 16 of the "C" frame 10.

Angularly pivotally connected with the first link 20 at the other end of the first link 20 remote from the end of the first link 20 joined to the "C" frame 10 is a second link 30, commonly referred to as the paddle. The second link 30 has a stainless steel blade 32 so that it will not snarl the fabric of the seat 40. The second link 30 has a bent arm 34 pivotally connected with a piston cylinder actuator 50.

The piston actuator 50, which is pivotally connected to the bent are 34 of the second link and to a stud 28 projecting from the first link 20, provides the lift means to angularly raise the second link 20.

In operation the installer brings the fixture to an area adjacent to one seat 40, which is in a storage area. The installer using handle 64 and/or handle 62 pivots the first link 20 towards the vehicle seat 40 allowing the blade 32 of the second link 30 to penetrate between the seat back 42 and seat cushion 44. The actuator 50 is then activated to extend, causing the second link 30 to angularly raise. The above action causes the seat 40 to be captured with the fixture 8 so that it may be transported by the overhead crane hook 90 into the vehicle door opening 70. The front of the first link has adjacent thereto a contact pad 80 which is coated with an enhanced frictional engaging elastomeric material 82 to aid in capturing the vehicle seat 40. To release the seat the second link 30 is lowered.

The present invention provides a method of installing a seat 40 into a vehicle, the method including the following steps:

1. Connecting to the lifting device 90 the upper leg 14 of a "C" frame 10 having upper 14 and lower legs 16;
2. Pivotally connecting with the "C" frame 10 a first link 20 projecting in a generally downward direction;
3. Pivotally connecting to the first link 20 a second link 30 at an end of the first link 20 remote from the "C" frame 10 and at an angle with the first link 20;
4. Penetrating between the seat back 42 and the seat cushion 44 the second link 30; and
5. Angularly lifting the second link 30 whereby the seat 40 is captured with the fixture 8;
6. Transporting the seat 40 with the lifting device 90.

While one embodiment of the present invention has been explained, it will be readily apparent to those skilled in the art of the various modifications which can be made to the present invention without departing from the spirit and scope of this application as it is encompassed by the following claims.

The embodiments of the invention in which an exclusive property or privilege is claimed are defined as follows:

1. A fixture for use with an overhead lifting device for transporting a seat having a seat back and a seat cushion into a vehicle, said fixture in combination comprising:

a "C" frame with spaced apart upper and lower legs, said upper leg providing means of connection with said lifting device;

a first link pivotally connected at one end with said lower leg of said "C" frame and projecting in a generally downward direction along a pivotal axis generally parallel with said lower leg;

a second link pivotally connected to the other end of said first link remote from said "C" frame at an angle with said first link for penetrating between said seat back and said seat cushion; and lift means to angularly raise said second link whereby said seat is captured with said fixture so that said seat can be transported by said lifting device.

2. A fixture as described in claim 1 further including at least one additional first link pivotally joined with the lower leg of said "C" frame, one additional second link pivotally joined to the other end of said first link remote from said lower leg of said "C" frame and a second lift means to angularly raise said additional second link.

3. A fixture as described in claim 1 wherein said lift means includes a piston actuator pivotably connected with said second link.

4. A fixture as described in claim 1 having in addition a contact pad adjacent to said first link for engaging with said seat back.

5. A fixture as described in claim 4 wherein said contact pad is coated with an enhanced frictional engaging elastomeric material.

6. A fixture as described in claim 1 wherein said second link is made of stainless steel.

7. A fixture for use with an overhead lifting device for transporting a seat having a seat back and a seat cushion into a vehicle, said fixture in combination comprising:

a "C" frame with spaced apart upper and lower legs, said upper leg providing means of connection with said lifting device;

left and right first links pivotally connected at one end with said lower leg of said "C" frame along a pivotal axis generally parallel with said lower leg and projecting in a generally downward direction;

a contact pad coated with an enhanced frictional engaging elastomeric material on each of said first links for engaging with said seat back;

left and right stainless steel second links pivotally joined to the other end of said respective first links remote from said "C" frame at an angle with said first links for penetrating between said seat back and said seat cushion; and a piston actuator pivotally connected with each of said respective first and second links to angularly raise said second links whereby said seat is captured with said fixture so that said seat can be transported by said lifting device.

8. A method of using a lifting device for transporting a seat with a seat back and a seat cushion into a vehicle, said method in combination comprising:

connecting to said lifting device an upper leg of a "C" frame having spaced apart upper and lower legs;

pivotally connecting with said "C" frame lower leg a first link projecting in a generally downward direction along a pivotal axis generally parallel with said lower leg;

pivotally connecting to said first link a second link at an end of said first link remove from said "C" frame and at an angle with said first link;

penetrating said second link between the seat back and seat cushion;

angularly lifting said second link whereby said seat is captured with said fixture; and transporting said seat with said lifting device whereby said seat is placed into said vehicle.

* * * * *